US005737947A

United States Patent [19]

Ling

[11] Patent Number: 5,737,947

[45] Date of Patent: Apr. 14, 1998

[54] MOTHER-AND-DAUGHTER COMBINATION LOCK

[76] Inventor: Chong-Kuan Ling, C/O Sinox Co., Ltd. P.O. Box 96-156, Taipei, Taiwan

[21] Appl. No.: 848,990

[22] Filed: May 2, 1997

[51] Int. Cl.[6] ..... E05B 65/52

[52] U.S. Cl. ..... 70/63; 70/312; 70/316

[58] Field of Search ..... 70/25, 52, 311, 70/312, 63, 316, 317, 318, 315

[56] References Cited

U.S. PATENT DOCUMENTS

| | | | |
|---|---|---|---|
| 877,682 | 1/1908 | Turman | 70/318 |
| 1,955,809 | 4/1934 | Hobbs | 70/52 |
| 2,163,852 | 6/1939 | Pond | 70/312 |
| 3,436,937 | 4/1969 | Barrett | 70/63 |
| 3,695,067 | 10/1972 | Bays | 70/63 |
| 3,837,189 | 9/1974 | Atkinson | 70/52 |
| 3,979,932 | 9/1976 | Piche | 70/63 |
| 4,641,505 | 2/1987 | Maurice | 70/63 |
| 4,649,723 | 3/1987 | Appelbaum | 70/63 |
| 4,838,052 | 6/1989 | Williams et al. | 70/63 |
| 4,869,082 | 9/1989 | Appelbaum | 70/63 |
| 5,046,339 | 9/1991 | Krell | 70/63 |
| 5,090,222 | 2/1992 | Imran | 70/63 |
| 5,134,869 | 8/1992 | Gable | 70/63 |
| 5,280,518 | 1/1994 | Danler et al. | 379/100 |

FOREIGN PATENT DOCUMENTS

| | | | |
|---|---|---|---|
| 1 271045 | 7/1990 | Canada | 70/63 |

*Primary Examiner*—Darnell M. Boucher

[57] ABSTRACT

A mother-and-daughter combination lock includes: a housing, a shackle lockable or unlockable in a first portion of the housing as controlled by a locking shaft and a plurality of dials and sleeves rotatably mounted in the housing; and a sliding door slidably held in the housing for covering and uncovering a security compartment recessed in a second portion of the housing as also controlled by the locking shaft, the dials and the sleeves, whereby either the shackle or the sliding door can be independently and individually locked or unlocked.

8 Claims, 5 Drawing Sheets

MOTHER-AND-DAUGHTER COMBINATION LOCK

BACKGROUND OF THE INVENTION

U.S. Pat. No. 4,869,082 to Paul Appelbaum disclosed a padlock cover with storage compartment including: a flexible, resilient, elongated lid member mounted in a guide means such that it has a closed position in which one end portion covers the storage compartment opening and the other end abuts the releasably locked leg of the shackle to hold the lid closed; and the lid member being slidable to an open position in which the compartment opening is uncovered when the shackle leg is released from the padlock case thereby unobstructing further guided movement of the lid.

In order to open the lid (17) slidably held in the lock casing, the padlock should be first unlocked to withdraw the shackle leg (33) without obstructing the upward sliding of the lid (17). Once the padlock is unlocked, it may be easily removed from a staple to be possibly lost.

Accordingly, it is impossible to lock the lid (17) independently and individually since the locking and unlocking of the lid (17) is synchronous to that of the shackle of the padlock. Once the padlock is unlocked, the storage compartment (47) will be spontaneously uncovered to lose its security effect for storing small items in the compartment (47).

The present inventor has found the drawbacks of the conventional padlock cover the storage compartment and invented the present mother-and-daughter combination lock.

SUMMARY OF THE INVENTION

The object of the present invention is to provide a mother-and-daughter combination lock including: a housing, a shackle lockable or unlockable in a first portion of the housing as controlled by a locking shaft and a plurality of dials and sleeves rotatably mounted in the housing; and a sliding door slidably held in the housing for covering and uncovering a security compartment recessed in a second portion of the housing as also controlled by the locking shaft, the dials and the sleeves, whereby either the shackle or the sliding door can be independently and individually locked or unlocked.

DETAILED DESCRIPTION

Figure 2:
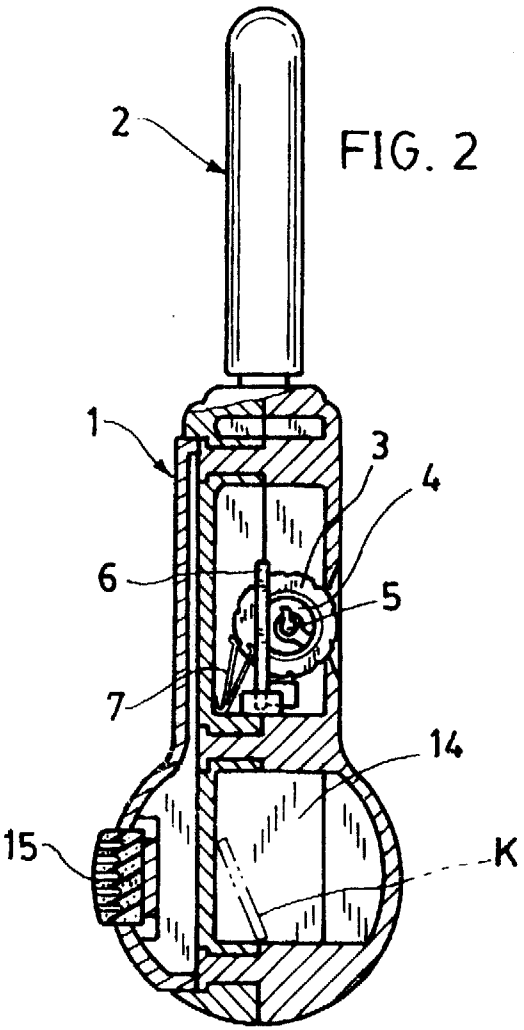
FIG. 2 is a side view of FIG. 1.

As shown in the drawing figures, the present invention comprises: a housing 1, a shackle 2 generally U shaped formed on a first (or upper) portion of the housing 1, a plurality of dials 3 and sleeves 4, each sleeve 4 resiliently coupled with each dial 3, rotatably mounted in the housing 1, a locking shaft 5 passing through the dials 3 and the sleeves 4, an actuating plate 6 operatively biased by the sleeves 4, a resilient plate 7 resiliently contacting the dials 3 and the actuating plate 6, a combination-changing means 8 for changing combinations of the dials 3, and a sliding door means 9 formed in a second (or lower) portion of the housing 1.

The housing 1 is formed with two shackle holes 11, 12 for the shackle 2 in an upper portion of the housing 1 for slidably engaging a short leg 21 and a long leg 22 of the shackle 2 of U shape; a security compartment 14 of the sliding door means 9 in a lower portion 1*b* of the housing 1 for storing small items such as keys (K), having a sliding door 13 slidably closing or opening the compartment 14; and an elastomer pad 15 fixed on a back portion of the housing for preventing slippery or impact of the housing on a wall. The elastomer pad 15 may also be eliminated.

Figure 5:
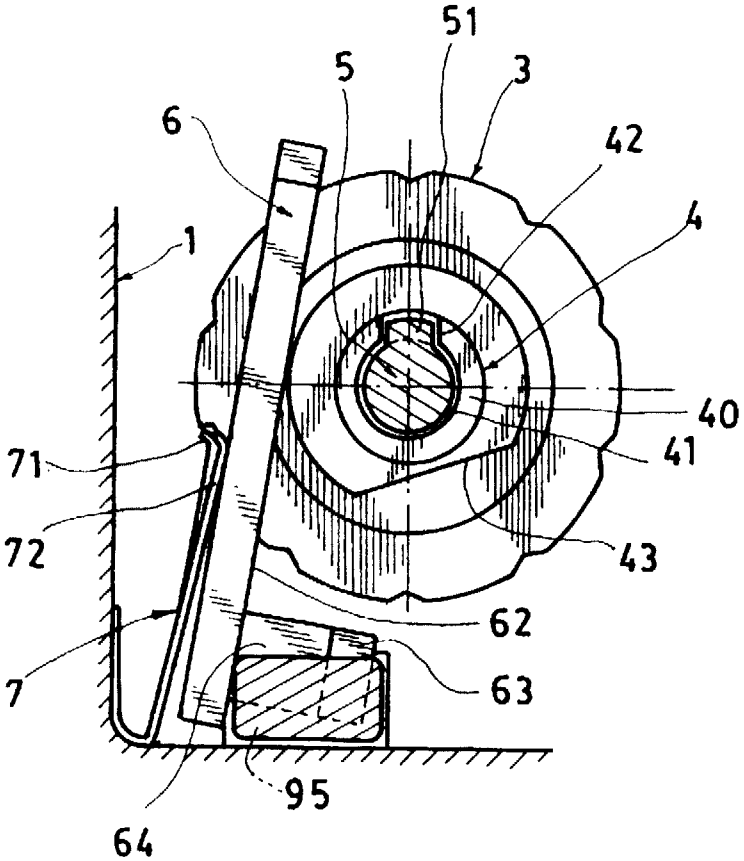
FIG. 5 is an illustration of the present invention wherein the shackle may be unlockable.

Each sleeve 4 is engageable with each dial 3. Each sleeve 4 as shown in FIGS. 3, 5 includes: a central hole 41 formed through the sleeve 4 for slidably engaging the locking shaft 5 within the central hole 41, an annular extension 40 annularly formed in the sleeve 4 and disposed around the central hole 41, a groove 42 longitudinally recessed in the annular extension 40 for slidably engaging a plurality of lugs 52 longitudinally formed and equally spaced on the locking shaft 5, a secant portion 43 formed on a periphery of the sleeve 4 to normally contact a flat surface 62 of the actuating plate 6 as shown in FIG. 3, and a bottom portion 44 formed on a bottom of the sleeve 4.

Figure 1:
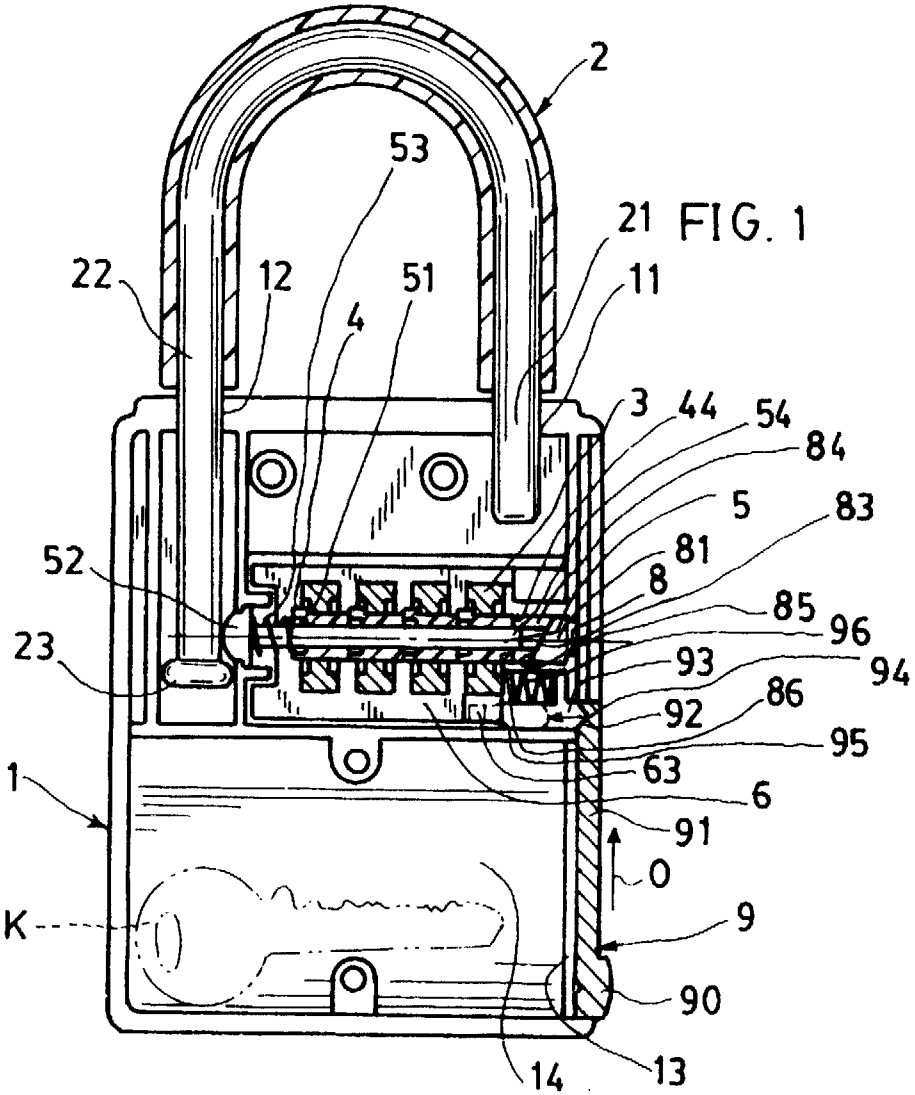
FIG. 1 is a sectional drawing of a front view of the present invention with the sliding door means unlockable.

The locking shaft 5 includes: a plurality of lugs 51 longitudinally formed and equally spaced on the shaft 5 each lug 51 normally retarded by an annular extension 40 of each sleeve 4 for locking the shackle and operatively slidably engageable with the each groove 42 recessed in each sleeve 4 for retracting the shaft 5 and the shaft head portion 52 when the shackle 2 is unlocked (FIG. 4) for uncoupling the shackle head portion 23 formed on a lowest end of the lug leg 22 of the shackle 2; and a tensioning spring 53 retained between the shaft head portion 52 and a sleeve 4 adjacent to the long leg 22 of the shackle 2 for normally tensioning the shaft head portion 52 towards the shackle head portion 23 to engage the shackle head portion 23 for locking the shackle 2 with the lug 52 of the shaft 5 retarded by each sleeve 4 as shown in FIG. 1; and a shaft end portion 54 positioned opposite to the shaft head portion 52 and adjacent to the combination-changing means 8.

Figure 3:
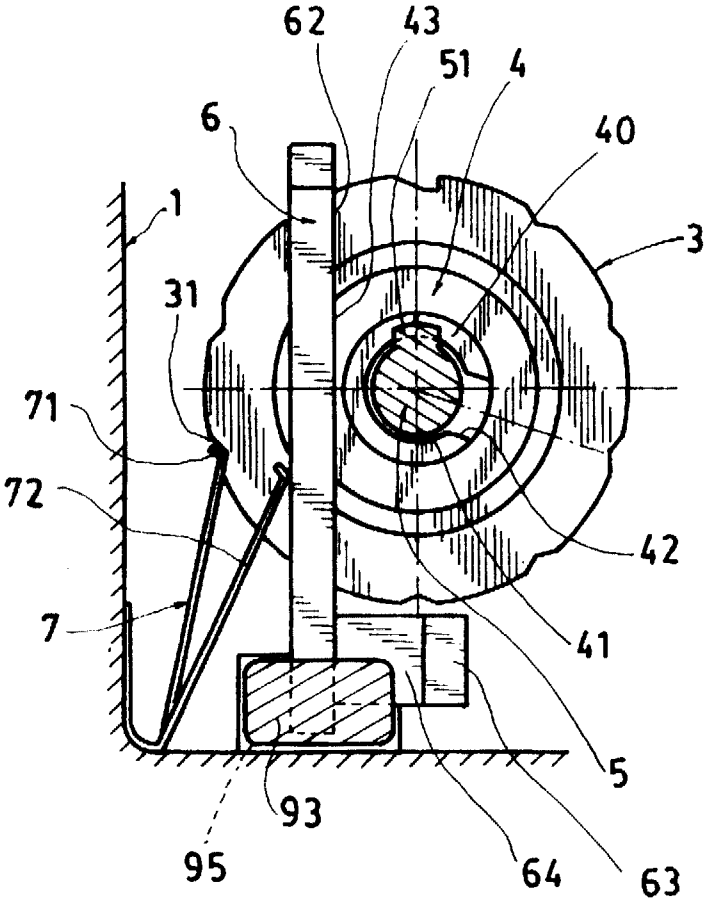
FIG. 3 is an illustration showing the sliding door means which is unlockable.

The actuating plate 6 is formed with a plurality of dial holes 61 for disposing each dial 3 in each dial hole 61, a flat surface 62 normally contacting a secant portion 43 of each sleeve 4 as shown in FIG. 3 when the shackle 2 is locked, a retarding extension 63 protruding from the actuating plate 6 towards of the sliding door means 9 for retarding an unlocking movement of the sliding door means 9 when locked, and a recess 64 recessed in the retarding extension 63 allowing an unlocking movement of the secondary lock 9 when unlocked.

The resilient plate 7 includes: a plurality of spring arm members 71 juxtapositioned from the resilient plate 7 to be resiliently engaged with each dial groove 31 between every two numerals on each dial for sensing the dialing, and an urging arm member 72 protruding from the resilient plate 7 for resiliently urging the actuating plate 6 ready for contacting the secant portion 43 of each sleeve 4 when the sliding door means 9 is unlocked.

Figure 4:
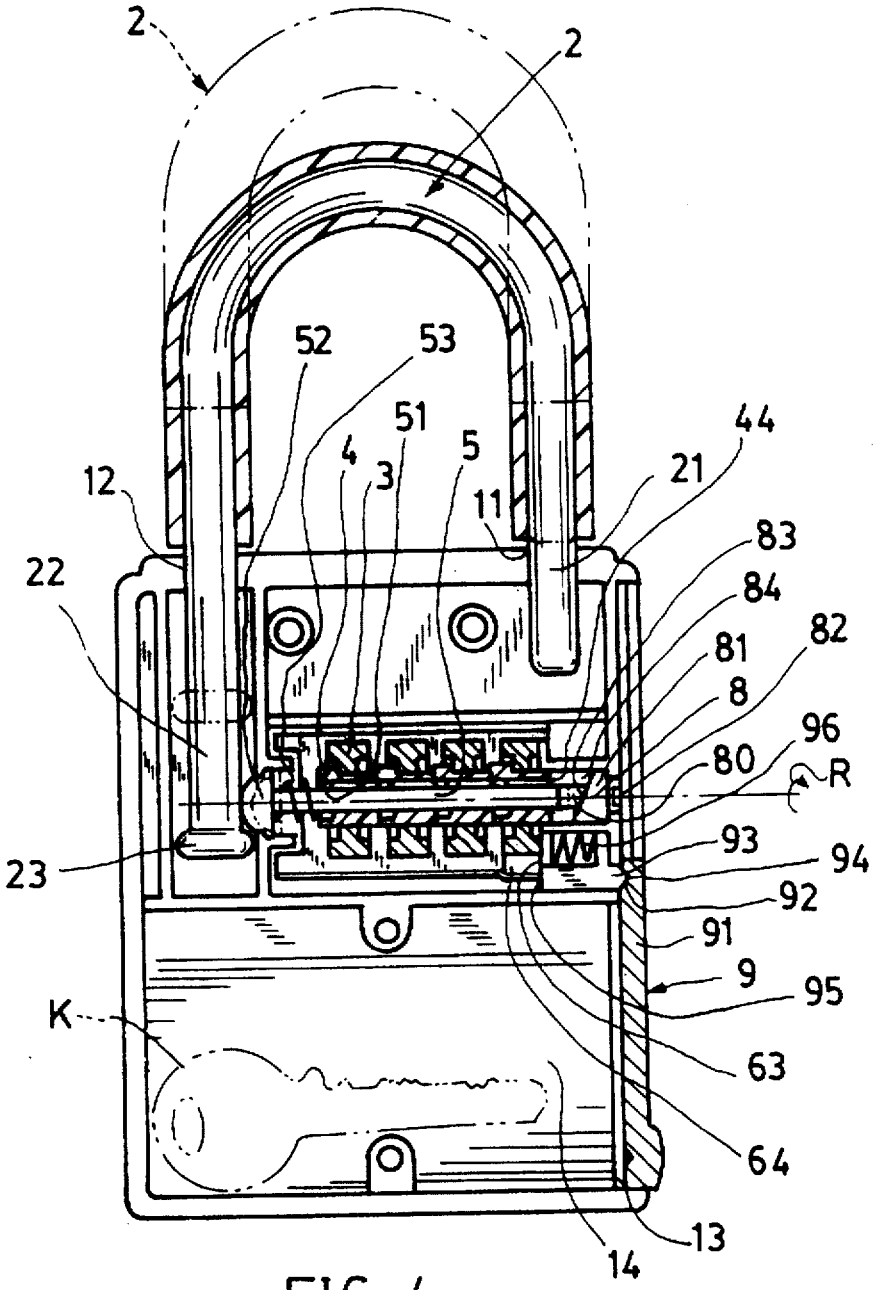
FIG. 4 is a front-view illustration of the present invention when the shackle is unlockable.
Figure 10:
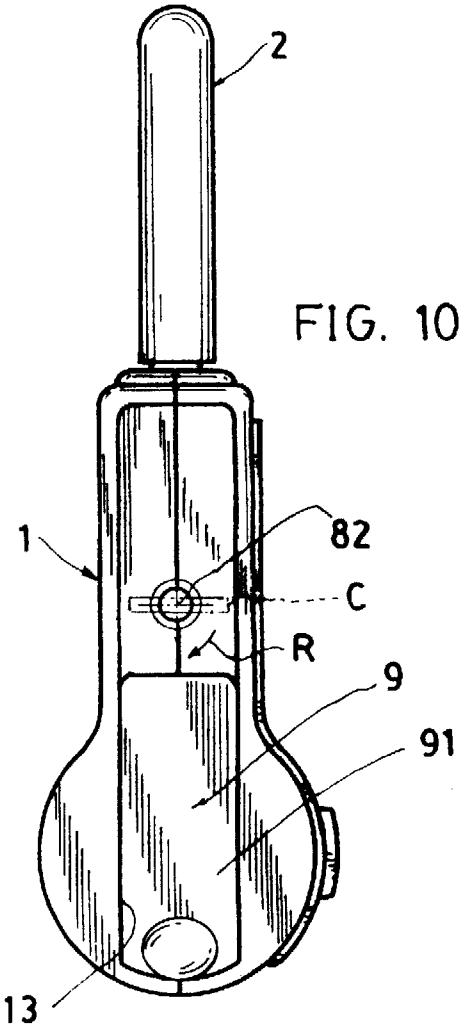
FIG. 10 is a side view of the present invention for resetting a new combination.
Figure 6:
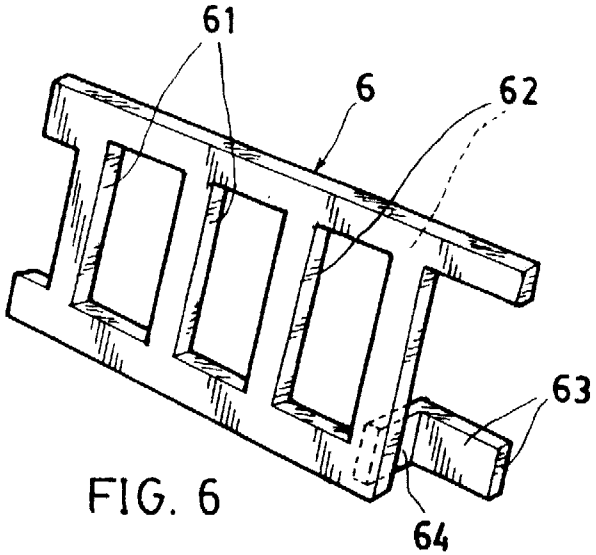
FIG. 6 is a perspective view of the actuating plate of the present invention.
Figure 7:
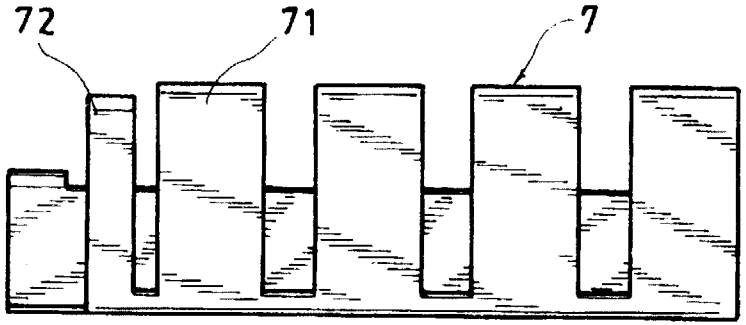
FIG. 7 is a front view of the resilient plate of the present invention.
Figure 9:
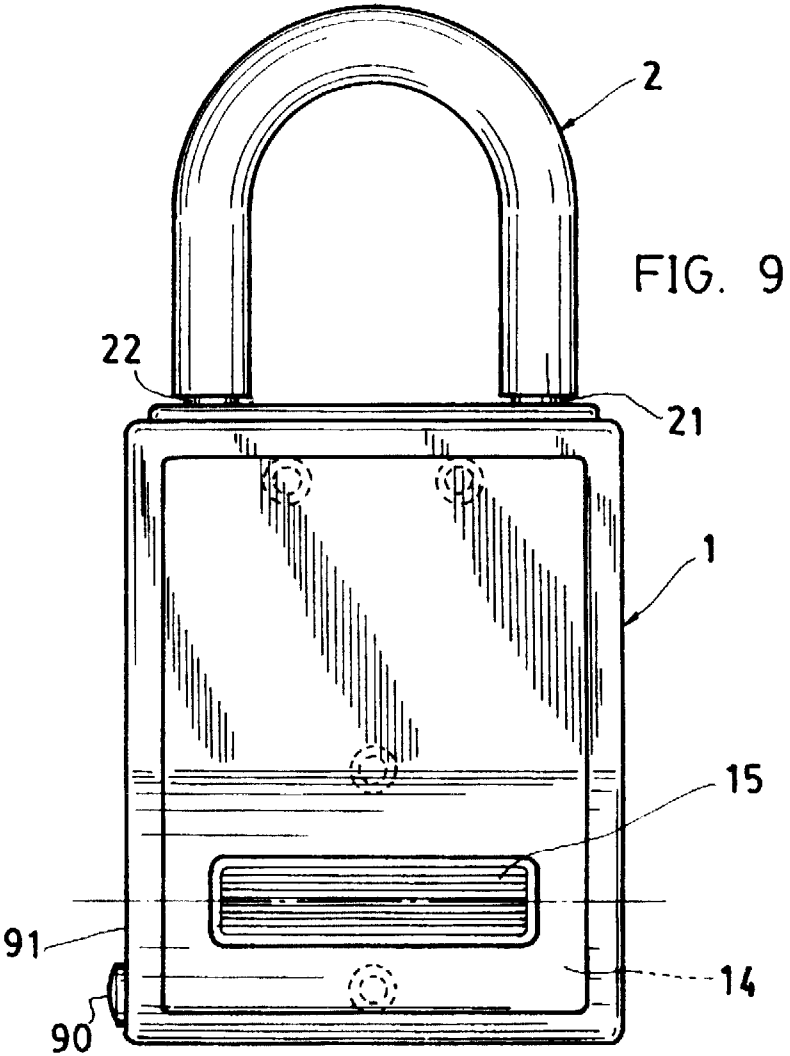
FIG. 9 is a rear view of the present invention.
Figure 8:
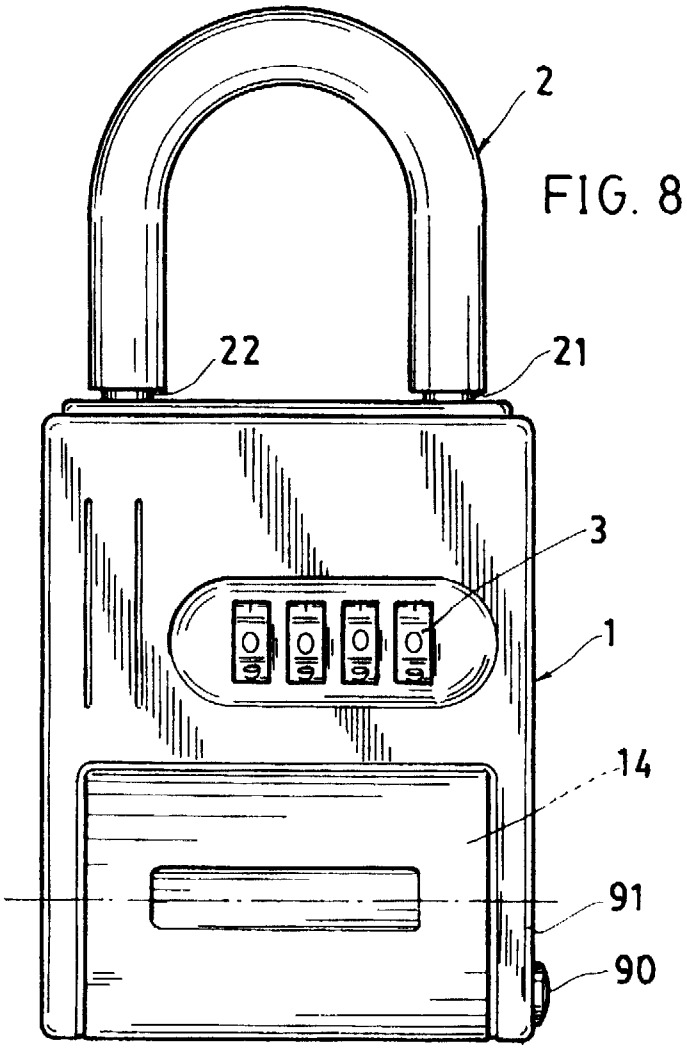
FIG. 8 is a front view of the present invention.

The combination-changing means 8 as shown in FIGS. 1, 4, 10 includes: a driving rotor 81 rotatably mounted in a side portion of the housing 1 having a slot 82 recessed in an outer portion of the rotor 81 for inserting a coin or other tool C for rotating (R) the rotor 81 and having a driving sloping surface 83 inclinedly formed on an inner portion of the rotor 81; a follower block 84 slidably mounted in the housing 1 and operatively driven by the driving rotor 81 having a follower sloping surface 85 inclinedly formed on an outer portion of the follower block 84 to be engageable with the driving sloping surface 83 on the driving rotor 81, a collar 86 formed on an inner end of the follower block 84 and normally contacting a bottom portion 44 of an outermost sleeve 4 adjacent to the driving rotor 81, and a shaft hole 80 formed in an inner portion of the follower block 84 or formed in the collar 86 for moving an outer end 54 of the locking shaft 5 into the shaft hole 80 when retracting the shaft 5 for unlocking the shackle 2 (FIG. 4). The collar 86 may also be unaligned (not shown) with the follower block 84 with the collar 86 secured to an inner portion of the follower block 84 for allowing a retraction of the shaft 5 into the collar hole when unlocking the shackle.

The sliding door means 9 includes: a sliding door 91 having a pushing knob 90 formed on the door slidably held in a sliding groove 13 recessed in a lower portion 1*b* of the housing 1 and normally closing a security compartment 14 recessed in the lower portion 1*b* of the housing 1 for storing small items K in the compartment 14, a thrusting surface 92 inclinedly formed on a driving end portion of the sliding door 91, a pushing plate 93 horizontally slidably held in the housing 1 having an inner end 95 lockable on a retarding extension 63 of the actuating plate 6 when the sliding door means 9 is locked, and a follower sloping end 94 inclinedly formed on an outer end of the pushing plate 93 to be engageable with the thrusting surface 92 of the sliding door 91, whereby when the pushing plate 93 is not retarded by the retarding extension 63 of the actuating plate 6 and upon an upward pushing of the sliding door 91, the thrusting surface 92 will inwardly thrust the follower sloping end 94 of the pushing plate 93 to poke the inner portion 95 of the push plate 93 into the recess 64 of the actuating plate 6 without being retarded to allow an upward sliding (O) of the sliding door 91 for opening the door 91 for unlocking the sliding door means 9 (FIGS. 1, 3).

When the shackle 2 of the present invention is locked as shown in FIGS. 1–3, the lugs 51 on the locking shaft 5 are retarded by the annular extensions 40 formed in the sleeves 4 to prevent the retraction of the locking shaft 5 to lock the shackle head portion 23 by the shaft head portion 52 of the locking shaft 5. At this time, the dials are rotated to a combination for unlocking the sliding door means 9 to allow each secant portion on each sleeve 4 to be contacted with the actuating plate 6 as vertically biased by the urging arm member 72 of the resilient plate 7 to unalign the retarding extension 63 of the actuating plate 6 from the pushing plate 93 of the sliding door means 9; whereby upon an upward pushing (O) of the sliding door 91 to allow the thrusting surface 92 formed on the sliding door 91 to inwardly thrust the follower sloping end 94 on the pushing plate 93 to push the pushing plate 93 inwardly, the pushing plate 93 is not retarded by the retarding extension 63 of the actuating plate 6 and will be retracted into the recess 64 of the actuating plate 6. Since the pushing plate 93 is retractable without obstructing the upward sliding of the sliding door 91, the door 91 will then be opened to unlock the sliding door means 9 for pick up or storage of small items K in the compartment 14.

When unlocking the shackle 2 as shown in FIGS. 4, 5, the dials 3 are rotated to another combination for unlocking the shackle 2 to simultaneously rotate the sleeves 4 to align the groove 42 in each sleeve 4 with each lug 51 on the locking shaft 5, the shaft 5 is no longer obstructed by the annular extension 40 formed in each sleeve 4 and the shaft 5 with the shaft head portion 52 is retracted towards the shaft hole 80 in the collar 86 of the combination-changing means 8 to unlock the shackle head portion 23 of the shackle 2, thereby allowing an upward pulling of the shackle 2 to release the short leg 21 from the shackle hole 11 for unlocking the shackle 2.

Meanwhile, the actuating plate 6 originally contacted with the secant portion 43 of the sleeve 4 will be biased (FIG. 3 to FIG. 5) to move the retarding extension 63 of the actuating plate 6 to face and retard the pushing plate 93, thereby preventing the sliding of the sliding door 91 and therefore locking the sliding door means 9.

For changing or resetting a new combination when the shackle 2 is unlocked, the driving rotor 81 is rotated (R) such as driven by a coin (FIGS. 10, 4) to inwardly thrust the follower block 84 to allow the collar 86 to push a bottom portion 44 to disengage the groove 42 in each sleeve 4 from each lug 51 on the locking shaft 5, thereby allowing a free rotation of the dials 3 and sleeves 4 for resetting a new combination. After finishing the new combination, the spring 53 will restore the sleeves 4 to be re-engaged with the shaft 5.

The present invention is superior to the conventional padlock having a storage compartment formed in the padlock with the following advantages:

1. Either the shackle 2 (which may be considered as "mother lock") or the sliding door means 9 (which may be considered as "daughter lock") can be independently locked or unlocked by using, however, an unique set of locking mechanism such as comprised of dials 3, sleeves 4, locking shaft 5, and actuating plate 6. So, two combinations can be set up respectively for unlocking the shackle 2 or the sliding door means 9 by using the same dials 3, sleeves 4 and the relevant mechanism without confusion or conflict therebetween.
2. Upon unlocking of the sliding door means 9 for taking something from the compartment 14, the shackle 2 is still locked on a staple (not shown) without missing. Similarly, once the shackle 2 is unlocked, the sliding door means 9 is however still locked. Therefore, this invention provides "double security" effects on a single lock device, beneficial for either "mother lock" or "daughter lock".

The present invention may be used for a padlock or other locks. The present invention may be modified without departing from the spirit and scope of this invention.

I claim:

1. A mother-and-daughter combination lock comprising:

a housing having a shackle movably securable in and releasable from a first portion of said housing;

a security compartment for storing small items therein formed in a second portion of said housing;

a sliding door means formed in said second portion of said housing, operatively lockable for closing said security compartment and unlockable for opening said security compartment;

a plurality of dials and sleeves rotatably mounted in said housing about a locking shaft longitudinally disposed in said sleeves, each said sleeve resiliently coupled with each said dial, whereby upon rotation of said dials to a first combination, said locking shaft is locked by said sleeves to lock said shackle; and an actuating plate resiliently contacted with and operatively biased by said sleeves, whereby upon a rotation of said dials to the first combination for locking said shackle, said actuating plate is biased to a first position to unlock the sliding door means; and upon a rotation of said dials to a second combination, said sleeves are rotated to bias said actuating plate to a second position to lock the sliding door means, and to unlock said locking shaft for unlocking said shackle.

2. A mother-and-daughter combination lock according to claim 1, wherein said housing is formed with two shackle holes for the shackle in an upper portion of the housing for slidably engaging a short leg and a long leg of the shackle of U shape in said two shackle holes; and the security compartment of the sliding door means formed in a lower portion of the housing for storing small items therein, having a sliding door slidably closing or opening the compartment.

3. A mother-and-daughter combination lock according to claim 1, wherein each said sleeve includes: a central hole formed through the sleeve for slidably engaging the locking shaft within the central hole, an annular extension annularly formed in the sleeve disposed around the central hole, a groove longitudinally recessed in the annular extension for slidably engaging a plurality of lugs longitudinally formed and equally spaced on the locking shaft, a secant portion formed on a periphery of the sleeve to normally contact a flat surface of the actuating plate, and a bottom portion formed on a bottom of the sleeve.

4. A mother-and-daughter combination lock according to claim 1, wherein said locking shaft includes: a plurality of lugs longitudinally formed and equally spaced on the shaft each said lug normally retarded by an annular extension of each said sleeve when the shackle is locked; and each said lug operatively slidably engageable with each said groove recessed in each said sleeve when the shackle is unlocked, and the shaft and a shaft head portion of the shaft is retractable for uncoupling the shackle head portion formed on a lowest end of the long leg of the shackle from the shaft head portion; and a tensioning spring retained between the shaft head portion and a sleeve adjacent to the long leg of the shackle for normally tensioning the shaft head portion towards the shackle head portion to engage the shackle head portion for locking the shackle with the lug of the shaft retarded by each said sleeve; and a shaft end portion positioned opposite to the shaft head portion and adjacent to a combination-changing means formed in said housing.

5. A mother-and-daughter combination lock according to claim 1, wherein said actuating plate is formed with a plurality of dial holes for disposing each said dial in each said dial hole, a flat surface contacting a secant portion of each said sleeve when the shackle is locked, a retarding extension protruding from the actuating plate towards the sliding door means for retarding an unlocking movement of the sliding door means when locked, and a recess formed in the retarding extension allowing an unlocking movement of the sliding door means when unlocked.

6. A mother-and-daughter combination lock according to claim 3, wherein said housing is mounted with a resilient plate therein, said resilient plate including: a plurality of spring arm members juxtapositioned from the resilient plate to be resiliently engaged with each dial groove formed between every two numerals formed on each said dial for sensing a dialing of the dials, and an urging arm member protruding from the resilient plate for resiliently urging the actuating plate ready for resiliently contacting each said sleeve.

7. A mother-and-daughter combination lock according to claim 4, wherein said combination-changing means includes: a driving rotor rotatably mounted in a side portion of the housing having a slot recessed in an outer portion of the rotor for inserting a tool for rotating the rotor and having a driving sloping surface inclinedly formed on an inner portion of the rotor; a follower block slidably mounted in the housing and operatively thrusted by the driving rotor when rotated, having a follower sloping surface inclinedly formed on an outer portion of the follower block to be engageable with the driving sloping surface on the driving rotor, a collar formed on an inner end of the follower block and normally contacting a bottom portion of an outermost sleeve adjacent to the driving rotor, and a shaft hole formed in an inner portion of the follower block for moving an outer end of the locking shaft into the shaft hole when retracting the shaft for unlocking the shackle, whereby upon rotation of the driving rotor to thrust the follower block inwardly, the sleeves will be pushed to be disengaged from the locking shaft for free rotating the dials for changing a combination.

8. A mother-and-daughter combination according to claim 1, wherein said sliding door means includes: a sliding door having a pushing knob formed on the door slidably held in a sliding groove recessed in a lower portion of the housing and normally closing the security compartment recessed in the lower portion of the housing for storing small items in the compartment, a thrusting surface inclinedly formed on a driving end portion of the sliding door, a pushing plate horizontally slidably held in the housing having an inner end lockable on a retarding extension of the actuating plate when the sliding door means is locked, and a follower sloping end inclinedly formed on an outer end of the pushing plate to be engageable with the thrusting surface of the sliding door, whereby when the pushing plate is not retarded by the retarding extension of the actuating plate and upon an upward pushing of the sliding door, the thrusting surface on the sliding door will inwardly thrust the follower sloping end of the pushing plate to poke the inner portion of the push plate unobstructedly into the recess of the actuating plate to allow an upward sliding of the sliding door for opening the door for unlocking the sliding door means.

* * * * *